US008855518B2

(12) United States Patent
Eom

(10) Patent No.: US 8,855,518 B2
(45) Date of Patent: Oct. 7, 2014

(54) IMAGE FORMING APPARATUS

(71) Applicant: Samsung Electronics Co., Ltd., Suwon-si (KR)

(72) Inventor: Yoon-seop Eom, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/856,558

(22) Filed: Apr. 4, 2013

(65) Prior Publication Data

US 2013/0223868 A1 Aug. 29, 2013

Related U.S. Application Data

(63) Continuation of application No. 12/099,239, filed on Apr. 8, 2008, now Pat. No. 8,447,205.

(30) Foreign Application Priority Data

Aug. 3, 2007 (KR) ..... 10-2007-0077944

(51) Int. Cl.
*G03G 15/00* (2006.01)
*G03G 21/16* (2006.01)

(52) U.S. Cl.
CPC ..... *G03G 15/80* (2013.01); *G03G 2221/166* (2013.01); *G03G 21/1652* (2013.01); *G03G 2221/1678* (2013.01)
USPC ..... 399/88; 399/90; 399/107

(58) Field of Classification Search
USPC ..... 399/88, 90, 107
See application file for complete search history.

(56) References Cited

U.S. PATENT DOCUMENTS

| | | | | |
|---|---|---|---|---|
| 7,873,294 | B2 | 1/2011 | Nobe et al. | |
| 2003/0230568 | A1 | 12/2003 | Yamanaka | |
| 2006/0147222 | A1 * | 7/2006 | Eom | 399/88 |

FOREIGN PATENT DOCUMENTS

| | | | |
|---|---|---|---|
| JP | 63101867 | A * | 5/1988 |
| JP | 04073778 | | 3/1992 |
| JP | 07319301 | A * | 12/1995 |
| JP | 11-146100 | | 5/1999 |
| JP | 2002132079 | A * | 5/2002 |
| JP | 2002-268309 | | 9/2002 |

(Continued)

OTHER PUBLICATIONS

Korean Office Action dated Mar. 12, 2013 issued in KR Application No. 10-2007-0077944.
Office Action dated Sep. 7, 2011 issued in U.S. Appl. No. 12/099,239.

(Continued)

*Primary Examiner* — David Gray
*Assistant Examiner* — Erika J Villaluna
(74) *Attorney, Agent, or Firm* — Stanzione & Kim, LLP

(57) ABSTRACT

An image forming apparatus includes a printing engine to form an image on a printing medium through printing processes, an engine frame to support the printing engine having a driving system to drive the printing engine, a high voltage power supply provided in a surface of the engine frame to apply a high voltage to at least one of units performing the printing processes, a main board provided in a surface of the engine frame adjacent to the surface having the high voltage power supply, and having a system engine controller to control the printing engine and a video controller to control a video signal, first and second main connectors respectively provided at lateral sides of the high voltage power supply and the main board adjacent to each other, and a connection control line to connect the first and second main connectors.

20 Claims, 7 Drawing Sheets

(56) References Cited

FOREIGN PATENT DOCUMENTS

| | | | |
|---|---|---|---|
| JP | 2004-021040 | | 1/2004 |
| JP | 2004053767 | | 2/2004 |
| JP | 2004-157463 | | 6/2004 |
| JP | 2004301877 | | 10/2004 |
| JP | 2005031447 | | 2/2005 |
| JP | 2005084546 A | * | 3/2005 |
| JP | 2006-264849 | | 10/2006 |

OTHER PUBLICATIONS

Final Office Action dated Mar. 13, 2012 issued in U.S. Appl. No. 12/099,239.

Office Action dated Jun. 20, 2012 issued in U.S. Appl. No. 12/099,239.

Final Office Action dated Oct. 12, 2012 issued in U.S. Appl. No. 12/099,239.

Notice of Allowance dated Jan. 4, 2013 issued in U.S. Appl. No. 12/099,239.

* cited by examiner

FIG. 1
(CONVENTIONAL)
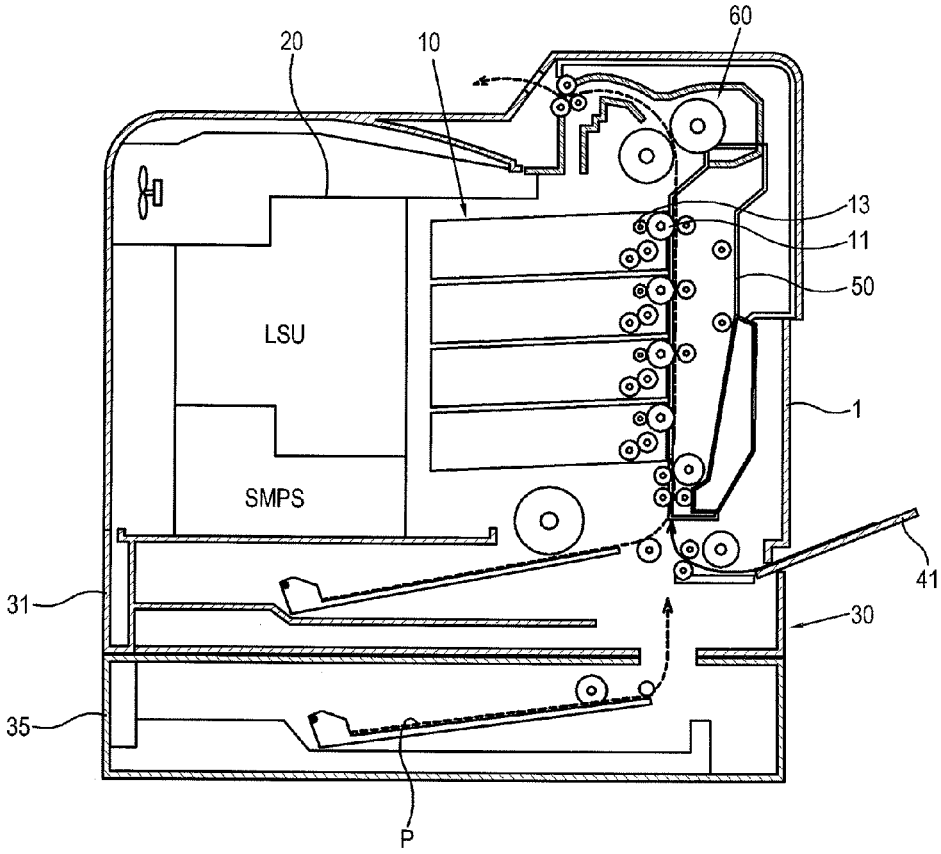

FIG. 2
(CONVENTIONAL)
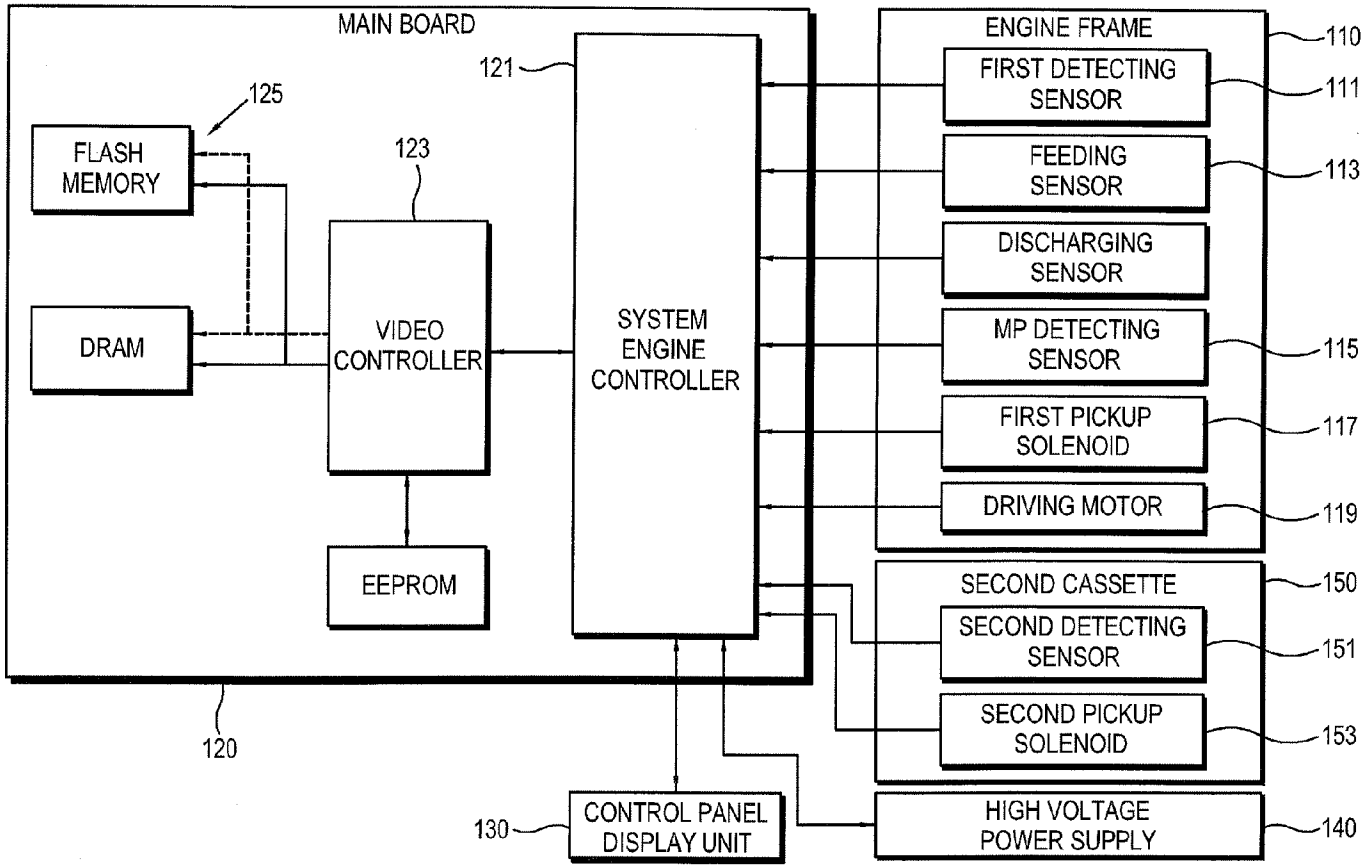

IMAGE FORMING APPARATUS

CROSS-REFERENCE TO RELATED APPLICATIONS

This is a Continuation Application of prior application Ser. No. 12/099,239, filed on Apr. 8, 2008 in the United States Patent and Trademark Office, which claims priority under 35 U.S.C. §119(a) from Korean Patent Application No. 10-2007-0077944, filed on Aug. 3, 2007, in the Korean Intellectual Property Office, the disclosure of which is incorporated herein by reference in its entirety.

BACKGROUND OF THE INVENTION

1. Field of the Invention

The present inventive concept relates to an image forming apparatus which forms an image on a printing medium, and more particularly, to an image forming apparatus which improves an arrangement configuration of a main board and a high voltage power supply, and a connection configuration between a sub electronic element and various boards.

2. Description of the Related Art

As illustrated in FIG. 1, an electrophotographic image forming apparatus includes a developing unit 10 having a photosensitive medium 11, a light scanning unit 20, a feeding unit 30, a transfer unit 50 and a fusing unit 60. The light scanning unit 20 scans light to the photosensitive medium 11 charged with a predetermined electric potential by a charging roller 13 to form an electrostatic latent image on the photosensitive medium 11. The developing unit 10 develops the electrostatic latent image with a predetermined color toner to form a visible image on the photosensitive medium 11. Then, the transfer unit 50 and the fusing unit 60 respectively transfer and fuse the visible image on a printing medium fed by the feeding unit 30 to print an image on the printing medium P.

The feeding unit 30 includes first and second cassettes 31 and 35 which are provided below a cabinet 1 of the image forming apparatus, and a multi-purpose printing medium feeding tray 41 which is provided at a lateral side of the cabinet 1.

The first and second cassettes 31 and 35 may include a sensor to detect a residual amount of a printing medium P stored therein, to detect the supply of the printing medium P and to register a front end of the printing medium P, and a sub electronic element having a driving circuit.

As illustrated in FIG. 2, a conventional image forming apparatus includes a printing engine (not illustrated), an engine frame 110 which supports the printing engine and has a driving system and various sensors, a main board 120 which controls a video signal and the printing engine, and a control panel display unit 130 which is provided to control a control panel.

The printing engine includes the photosensitive medium 11, the charger 13 which forms the electrostatic latent image and the visible image on the photosensitive medium 11, the light scanning unit 20 and the developing unit 10 as illustrated in FIG. 1. The printing engine further includes the transfer unit 50 which transfers the visible image formed on the photosensitive medium 11 to the printing medium P, and the fusing unit 60 which fuses the visible image transferred to the printing medium P.

The conventional image forming apparatus further includes a high voltage power supply (HVPS) 140 which is electrically connected with the main board 120 and applies a high voltage to the developing unit 10, the charger 13, the transfer unit 50 and a static eliminator.

The engine frame 110 includes a first detecting sensor 111 which detects whether the printing medium P is stored in the first cassette 131 (refer to FIG. 1), a feeding sensor 113 which detects the supply state of the printing medium P, an MP detecting sensor 115 which detects the printing medium P in the multi purpose tray 41, a first pickup solenoid 117 which is provided to pick up the printing medium P, and a driving motor 119.

The main board 120 includes a system engine controller 121, a video controller 123 which controls a video signal, and a memory 125 which stores information therein to form an image. The system engine controller 121 controls the engine frame 110, the control panel display unit 130, the high voltage power supply 140 and the sub electronic elements of the second cassette 150. The second cassette 150 includes the sub electrode elements, i.e. a second detecting sensor 151 which detects whether the printing medium P is stored in the second cassette 150, and a second pickup solenoid 153. The memory includes a flash memory, a DRAM (dynamic random access memory), an EEPROM (electrically erasable programmable read-only memory), etc.

As illustrated in FIG. 2, sub electronic element control signal lines are additionally connected between the main board 120 and the engine frame 110 of the conventional image forming apparatus. Thus, the configuration of the sub electronic element control signal lines becomes complicated, thereby requiring more space.

As the sub electronic elements of the first and second cassettes 131 and 150 are directly connected with the main board 120, the connection line therebetween extends depending on a position of the main board 120, thereby raising costs. Also, the sub electronic elements are difficult to replace, assemble and disassemble.

As the respective sub electronic elements are directly connected with the main board 120, noise signal components such as static electricity generated during the printing medium feeding process are also directly transmitted to the main board 120, thereby lowering reliability of the connection.

SUMMARY OF THE INVENTION

The present inventive concept provides an image forming apparatus to optimize an arrangement configuration of a main board and a high voltage power supply and to simplify a signal connection line between sub electronic elements and the main board.

Additional aspects and utilities of the present inventive concept will be set forth in part in the description which follows and, in part, will be obvious from the description, or may be learned by practice of the present inventive concept.

The foregoing and/or other aspects and utilities of the present general inventive concept can be achieved by providing an image forming apparatus including a printing engine to form an image on a printing medium through printing processes; an engine frame to support the printing engine and having a driving system to drive the printing engine, a high voltage power supply provided in a surface of the engine frame to apply a high voltage to at least one of units performing the printing processes, a main board provided in a surface of the engine frame adjacent to the surface having the high voltage power supply, and having a system engine controller to control the printing engine and a video controller to control a video signal, first and second main connectors respectively provided at lateral sides of the high voltage power supply and the main board adjacent to each other, and a connection control line to connect the first and second main connectors.

The high voltage power supply may be provided at a lateral side of the engine frame to directly contact an electrode of at least one of the units performing the printing processes to apply a high voltage thereto, and the main board may be provided at a rear side of the engine frame.

The image forming apparatus may further include a first control panel to display an operation state of the printing engine and to control the printing engine, and a first control panel board to control the first control panel, wherein the first control panel board is connected with a first control panel connector provided in the high voltage power supply.

The first control panel board may be provided in an upper portion of the engine frame, and the first control panel connector may be adjacent to an upper portion of the high voltage power supply.

The image forming apparatus may further include a second control panel to display an operation state of the main board and to control the main board, and a second control panel board to control the second control panel, wherein the second control panel board is connected with a second control panel connector provided in the main board.

The image forming apparatus may further include a discharging sensor to detect whether a printing medium fused through the fusing process is discharged, and is connected with a discharging sensor connector adjacent to the upper portion of the high voltage power supply.

The image forming apparatus may further include a first cassette having at least one sub electronic element among a printing medium detecting sensor to detect whether a printing medium is stored therein, a pickup unit to pick up the printing medium and a duplexer unit to print on both sides of the printing medium, a first feeding connector provided in the first cassette to be electrically connected with the sub electronic element, and a second feeding connector electrically connected with the high voltage power supply, and connected with the first feeding connector if the first cassette is installed.

The first cassette may be attached to a lower side of the engine frame to be detachable from a front side to a rear side of the engine frame, and the second feeding connector may be adjacent to a lower side of the high voltage power supply, and is selectively connected with the first feeding connector depending on an attachment and detachment state of the first cassette.

The high voltage power supply may include a high voltage generating circuit to generate a high voltage to be applied to at least one of the units performing the printing processes, a control signal relay circuit to relay an input control signal to the main board, and a cover switch which is switched on and off by opening and closing a cover of the image forming apparatus and to control a signal supplied by the high voltage generating circuit.

The control signal relay circuit may further include a filter to filter noise components included in the relayed control signal.

The image forming apparatus may further include a second cassette having at least one sub electronic element among a printing medium detecting sensor to detect whether the printing medium is provided therein, and a pickup unit to pick up the printing medium, and is electrically connected with the main board.

The image forming apparatus may further include a first light scanning connector provided in a predetermined position of a light scanning unit to perform an exposing process, and a second light scanning connector which is provided in a predetermined position of the main board facing the first light scanning connector, and is connected with the first light scanning connector.

The image forming apparatus may further include a fusing driver board controlled by the main board to supply AC power to the fusing unit to perform a fusing process and to drive the fusing unit, and a switching mode power supply to convert AC power applied by the fusing driver board into DC power to be supplied to the main board, wherein, the fusing driver board and the switching mode power supply are disposed in the rear side of the engine frame to be adjacent to the main board.

The foregoing and/or other aspects and utilities of the present general inventive concept can also be achieved by providing an image forming apparatus including an engine frame to support a printing engine to form an image on a printing medium, a cassette detachably attached to the engine frame having a sub electronic element, a high voltage power supply to apply a high voltage to at least one of units of the printing engine to perform printing processes, a main board to control the printing engine and a video signal, a first feeding connector provided in the cassette to be electrically connected with the sub electronic element, and a second feeding connector which is electrically connected with the high voltage power supply, and is connected with the first feeding connector if the cassette is installed.

The high voltage power supply may be provided at a lateral side of the engine frame, and the main board may be provided in a rear side of the engine frame.

The image forming apparatus may further include first and second connectors respectively provided at lateral sides of the high voltage power supply and the main board adjacent to each other, and a connection control line which may connect the first and second connectors.

The foregoing and/or other aspects and utilities of the general inventive concept may also be achieved by providing an image forming apparatus including a main board having a connector and one or more controllers, a high voltage power supply (HVPS) adjacent to the main board, and having an other connector, and a connection control line to connect the one connector and the other connectors.

The one connector and the other connector may be disposed at lateral sides of the HVPS and the main board adjacent to each other, respectively.

The foregoing and/or other aspects and utilities of the general inventive concept may also be achieved by providing an image forming apparatus including a high voltage power supply (HVPS), an engine frame having a feeding connector electrically connected with the HVPS, one or more cassettes detachably attached to the engine frame, and having one or more sub electronic elements and an other feeding connector to be electrically connected with the one or more sub electronic elements, wherein the one feeding connector and the other feeding connector are selectively connected with each other depending on an attachment state of the one or more cassettes.

The image forming apparatus may further include a grounding signal line electrically connecting the one or more sub electronic elements and the HVPS.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 1 is a schematic sectional view illustrating a conventional image forming apparatus;

FIG. 2 is a block diagram illustrating the conventional image forming apparatus of FIG. 1;

DETAILED DESCRIPTION OF THE PREFERRED EMBODIMENTS

Figure 3:
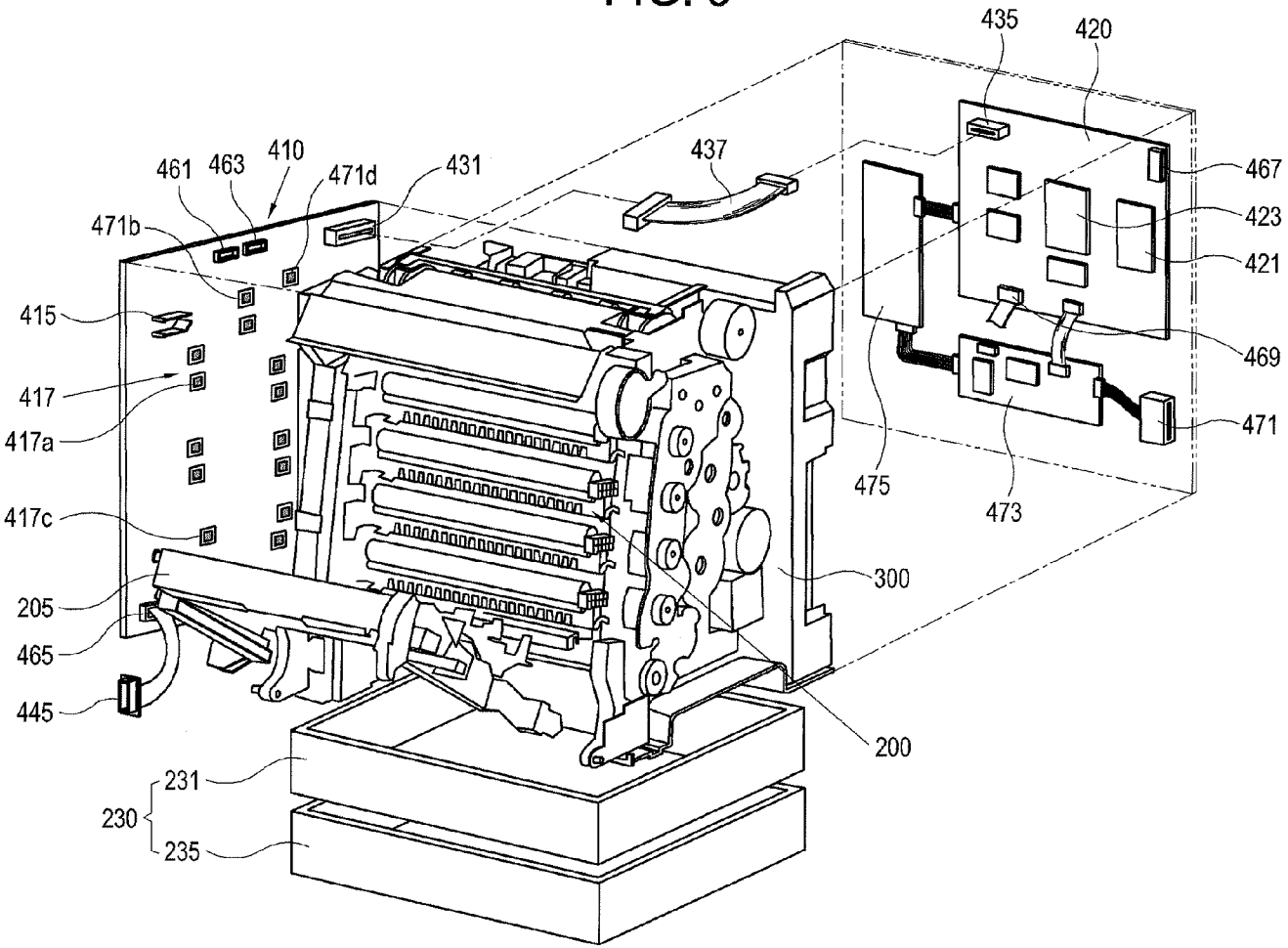
FIG. 3 is an exploded perspective view illustrating an image forming apparatus according to an exemplary embodiment of the present inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
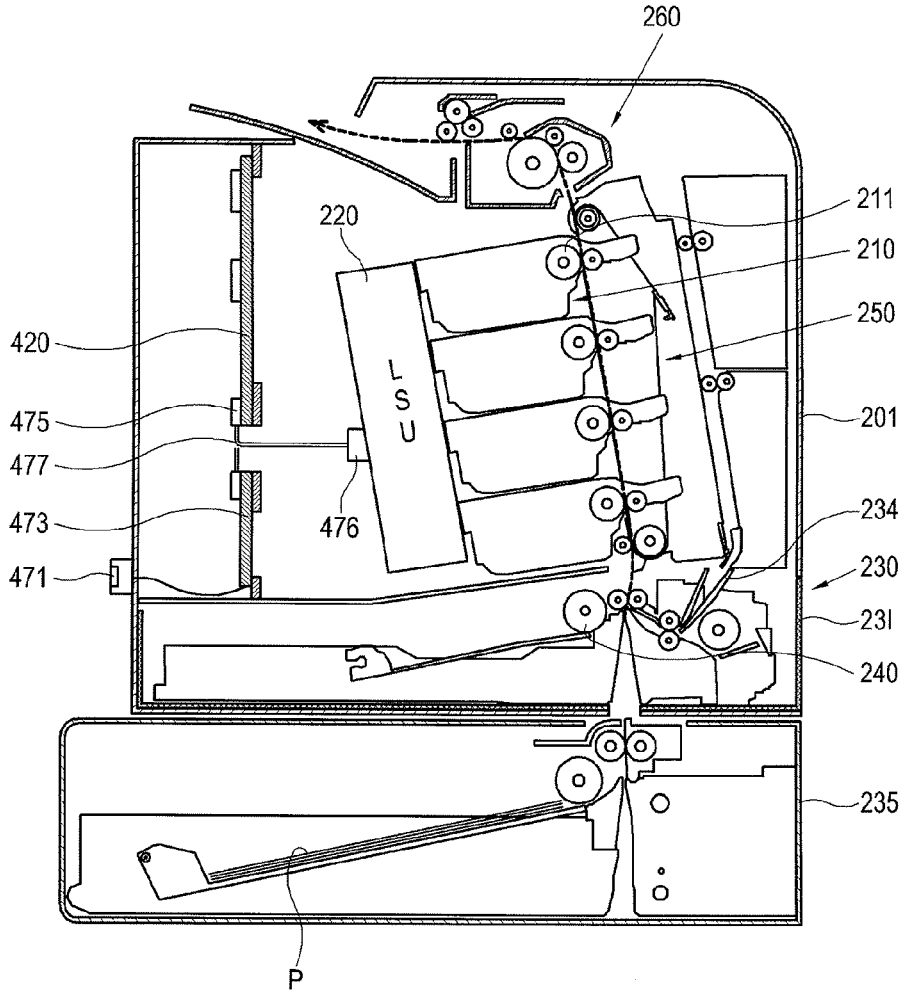
FIG. 4 is a schematic sectional view illustrating the image forming apparatus according to the exemplary embodiment as illustrated in FIG. 3.
Figure 5:
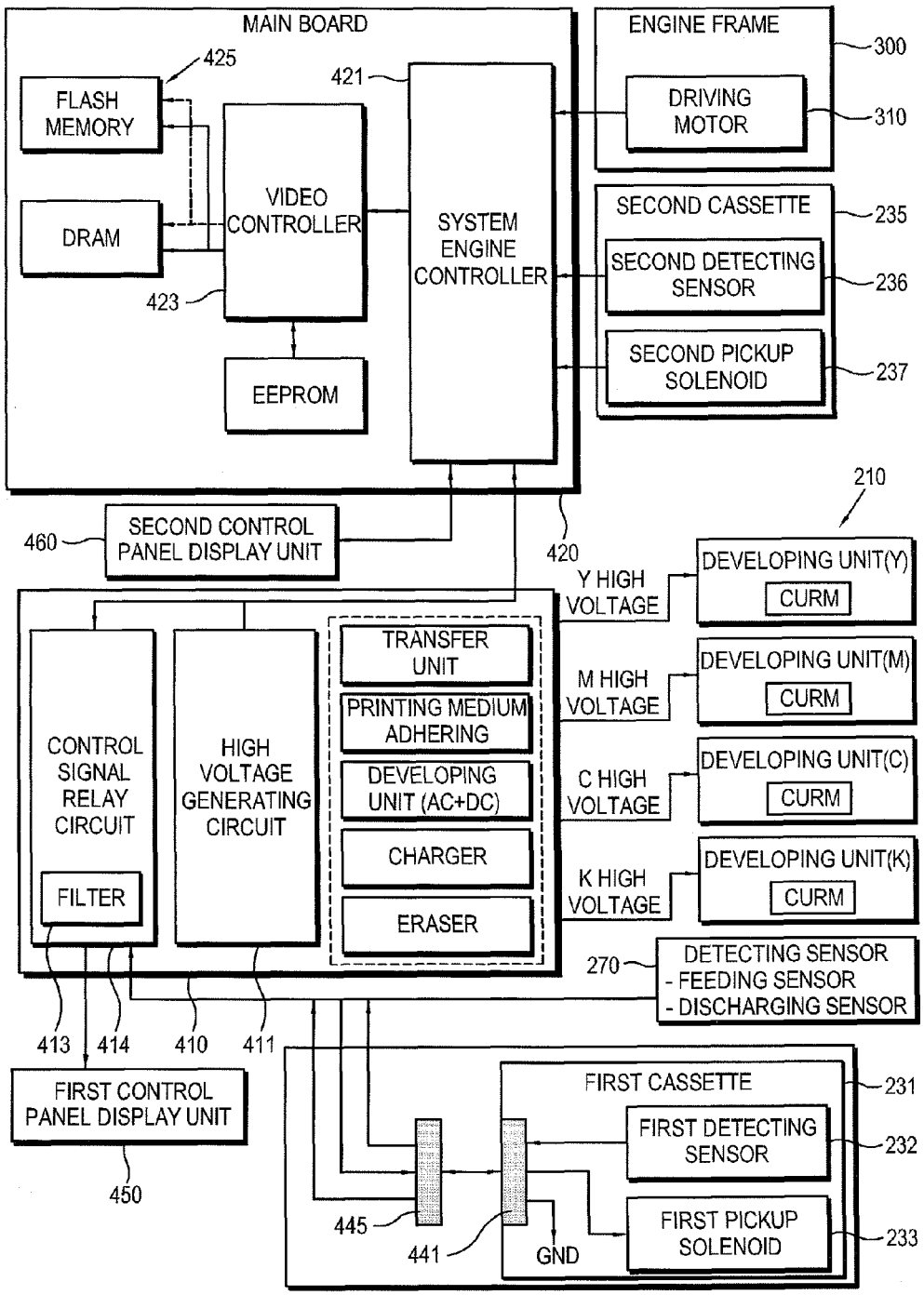
FIG. 5 is a system block diagram illustrating the image forming apparatus according to the exemplary embodiment as illustrated in FIG. 3.
Figure 6:
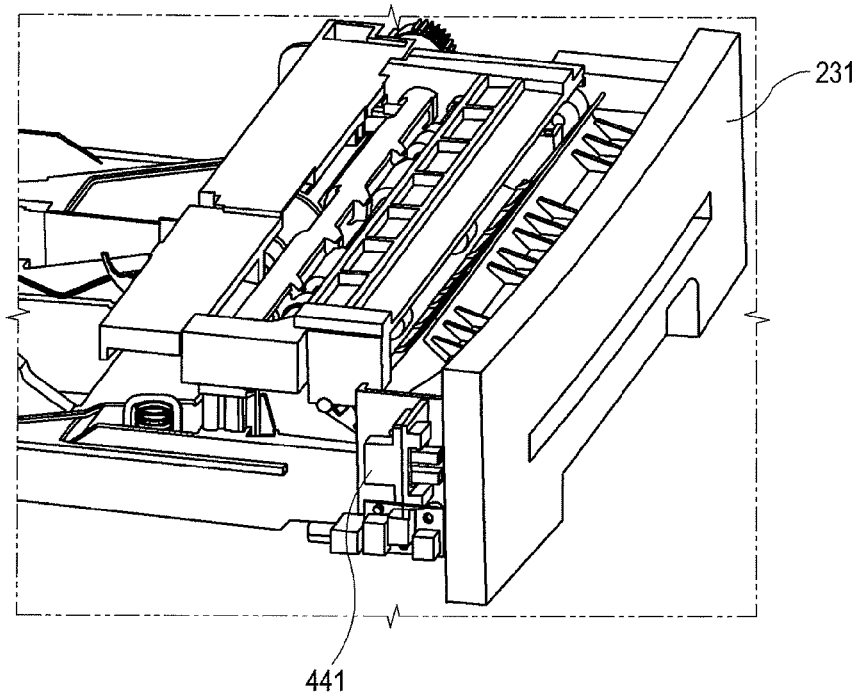
FIG. 6 is a partial perspective view illustrating main portions of a first cassette employed in the image forming apparatus according to the exemplary embodiment as illustrated in FIG. 3.
Figure 7:
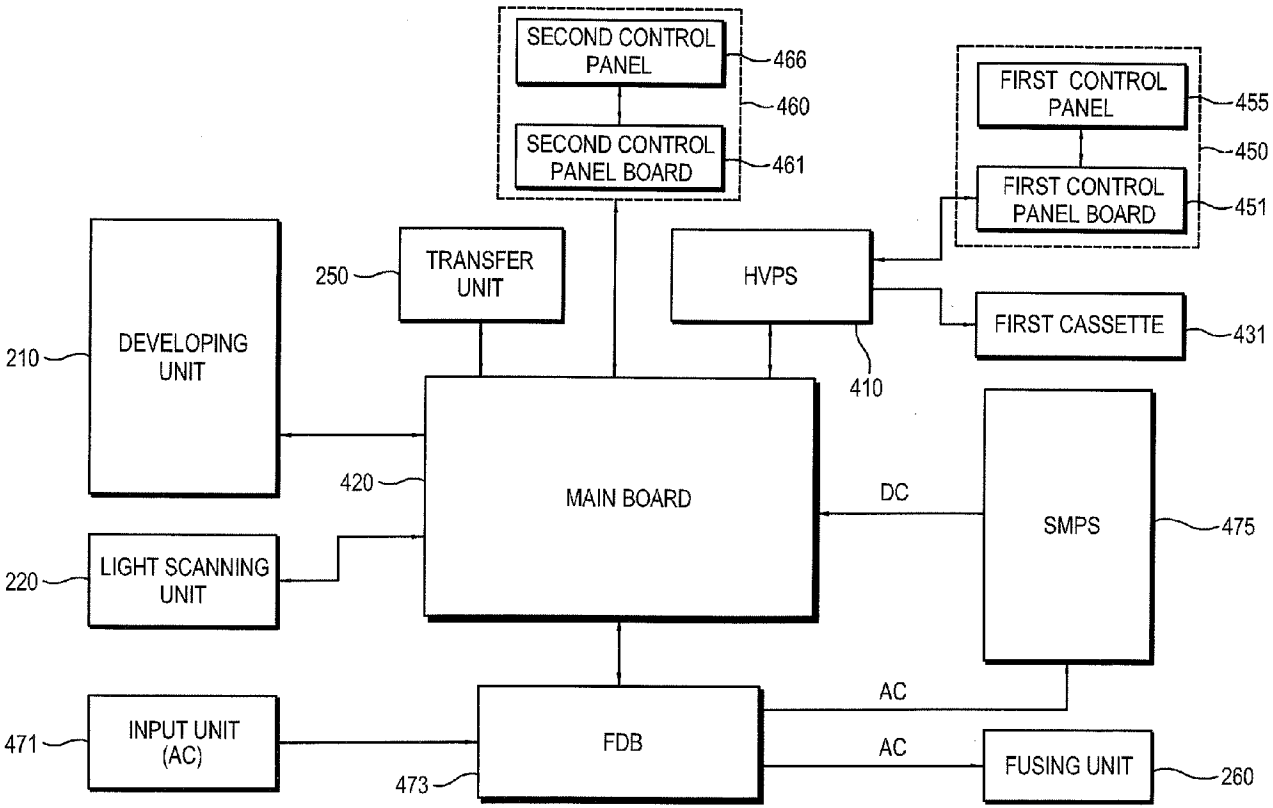
FIG. 7 is a block diagram illustrating a harness path between boards of the image forming apparatus according to the exemplary embodiment as illustrated in FIG. 3.

FIGS. 3 and 4 are a respective exploded perspective view and a schematic sectional view illustrating an image forming apparatus according to an exemplary embodiment of the present inventive concept. FIG. 5 is a system block diagram illustrating the image forming apparatus according to the exemplary embodiment as illustrated in FIG. 3. FIG. 6 is a partial perspective view illustrating main portions of a first cassette employed in the image forming apparatus according to the exemplary embodiment as illustrating in FIG. 3. FIG. 7 is a block diagram illustrating a harness path between boards of the image forming apparatus according to the exemplary embodiment as illustrated in FIG. 3.

As illustrated in FIG. 3, the image forming apparatus according to an exemplary embodiment of the present inventive concept includes a printing engine 200 to form an image on a printing medium through printing processes, an engine frame 300 to support the printing engine 200, a high voltage power supply (hereinafter, to be called HVPS) 410 to apply power to the printing engine 200, a main board 420 to control the printing engine 200 and a video signal, first and second main connectors 431 and 435 which are provided in the HVPS 410 and the main board 420, respectively, and a connection control line 437 to connect the first main connector 431 and the second main connector 435.

The printing engine 200 forms an image on a printing medium through printing processes including, for example, charging, exposing, developing, transferring and fusing processes. As illustrated in FIG. 4, the printing engine 200 (FIG. 3) includes a developing unit 210 having a photosensitive medium 211, a light scanning unit (LSU) 220, a feeding unit 230, a transfer unit 250 and a fusing unit 260. FIG. 4 exemplifies a single path type color image forming apparatus to form images in black K, yellow Y, magenta M and cyan C colors.

The light scanning unit 220 is turned on and off by a video signal applied by the main board 420. The light scanning unit 220 scans light to the color photosensitive media 211 charged with a predetermined electric potential by a charger (not illustrated) to form an electrostatic latent image on the photosensitive media 211. The developing unit 210 develops the electrostatic latent image with a predetermined color toner to form a visible image on the photosensitive media 211. The transfer unit 250 and the fusing unit 260 respectively transfer and fuse the visible image on a printing medium P fed by the feeding unit 230, thereby printing an image on the printing medium. The feeding unit 230 may include first and second cassettes 231 and 235 which are provided, for example, in an upper and lower arrangement including an upper position and lower position both being below a cabinet 201 of the image forming apparatus.

The first and second cassettes 231 and 235 include a sensor to detect a residual amount of the printing medium P stored therein, to detect the supply state of the printing medium P and to register a front end of the printing medium P, and a sub electronic element 240 including a driving circuit.

As illustrated in FIG. 5, sub electronic elements of the first cassette 231 includes at least one of a first detecting sensor 232 to detect whether the printing medium P is stored in the first cassette 231, a pickup unit including a first pickup solenoid 233 provided to feed the printing medium P and a duplexer unit 234 (refer to FIG. 4) to print on both sides of the printing medium P. The sub electronic elements of the second cassette 235 include a second detecting sensor 236 and a pickup unit including a second pickup solenoid 237 provided to feed the printing medium P.

If the first and second cassettes 231 and 235 having the sub electronic elements to provide printing medium feeding are provided in a main body of the image forming apparatus as described above, power can be supplied from the main body to the sub electronic elements and the signal detected by the sub electronic elements can be transmitted to the main board 420. To satisfy the requirement, the image forming apparatus according to the exemplary embodiment of the present inventive concept includes a first feeding connector 441 which is provided in the first cassette 231 to be electrically connected with the sub electronic elements and a second feeding connector 445 which is electrically connected with the HVPS 410 as illustrated in FIG. 3.

The first cassette 231 is attached to a lower side of the engine frame 300 so that the first cassette 231 is detachable from a front side to a rear side of the engine frame 300 (i.e. from the right to the left in FIG. 4).

The second feeding connector 445 is firmly attached corresponding to the first feeding connector 441 of the engine frame 300. That is, the second feeding connector 445 is provided in the engine frame 300 to be adjacent to a lower side of the HVPS 410.

The first and second feeding connectors 441 and 445 are selectively connected with each other depending on an attachment and detachment state of the first cassette 231. The first and second feeding connectors 441 and 445 may include a drawer connector, respectively. The first feeding connector 441 includes a grounding structure as illustrated in FIG. 5. According to the grounding structure, a ground signal line of the sub electronic elements of the first and second cassettes 231 and 235 may be also used as the ground signal line connecting the HVPS 410 and the main board 420.

As illustrated in FIG. 3, the engine frame 300 supports the printing engine 200, and includes a driving system to drive the printing engine 200. For example, the driving system may include a driving motor 310 (FIG. 5) to drive units included in the printing engine 200 to perform printing processes.

The HVPS 410 is provided in one side of the engine frame 300, and applies a high voltage to at least one of the units performing the printing processes.

The HVPS 410 can be provided at a lateral side of the engine frame 300 to be directly connected with an electrode of at least one of the units performing the printing processes and to apply a high voltage thereto. If the HVPS 410 is provided at the lateral side of the engine frame 300 as described above, the HVPS 410 may be electrically connected with the first cassette 231 including the sub electronic elements (to be described later) without difficulty and may apply the high voltage generated by the HVPS 410 to electrodes of the respective units performing the printing processes.

As illustrated in FIG. 5, the HVPS 410 includes a high voltage generating circuit 411 to generate a high voltage to be applied to at least one of the units performing the printing processes, and a control signal relay circuit 413 to relay an input control signal to the main board 420. The HVPS 410 is operated as a cover 205 of the image forming apparatus and is open and closed. The HVPS 410 can further include a cover switch 412 which is switched on and off to control a signal supplied by the high voltage generating circuit 411. The control signal relay circuit 413 may further include a filter 414 to filter noise components included in the relayed control signal. In this case, noise components such as static electricity of the control signal line of the first and second cassettes 231 and 235 having the sub electronic elements may be filtered, thereby transmitting filtered signal components to the main board 420. Thus, connection reliability of the image forming apparatus may improve.

As illustrated in FIGS. 3 and 5, the HVPS 410 includes an applying electrode 417 to supply the high voltage generated by the high voltage generating circuit 411 to the respective units performing the printing processes. That is, the HVPS 410 includes a transfer high voltage applying electrode 417*a* to contact the transfer unit 250 and to apply the high voltage thereto, a developing high voltage applying electrode 417*b* to contact the developing unit 210 and to apply the high voltage thereto, a printing medium adhering high voltage applying electrode 417*c* to apply the high voltage to adhere printing medium, and a charging voltage applying electrode 417*d* to apply a charging voltage. The HVPS 410 may further include an electrode (not illustrated) to apply the high voltage to an eraser to eliminate an electric potential remaining in the photosensitive media 211 after the developing process.

The HVPS 410 further includes a first control panel connector 461 which is connected with a first control panel board 451 of the first control panel display unit 450, a discharging sensor connector 463 which is connected with a discharging sensor and a second feeding connecting unit 465 which is connected with the second feeding connector 445. The configuration of the connectors will be described later in detail.

The main board 420 is provided in one side of the engine frame 300 adjacent to the HVPS 410. The main board 420 can be disposed in a rear side of the engine frame 300.

The main board 420 includes an integrated board to control the printing engine 200 and the video signal. The main board 420 can include a system engine controller 421 to control the printing engine 200, a video controller 423 to control the video signal applied to the light scanning unit 220 and a memory 425 to store information therein to form an image. The memory 425 includes a flash memory, a DRAM (dynamic random access memory), an EEPROM (electrically erasable programmable read-only memory), etc.

The system engine controller 421 is directly connected with the engine frame 300, the HVPS 410, a second control panel display unit 460 and the sub electronic elements 236 and 237 of the second cassette 235 and controls the foregoing elements. The system engine controller 421 is indirectly connected with the first control panel display unit 450 and the sub electronic elements 232 and 233 of the first cassette 231 through the HVPS 410, and controls the foregoing elements.

The foregoing connection configuration is set in consideration of the position of the respective boards in the engine frame 300, the attachment and detachment state of the first cassette 231 and an installation position of the first control panel display unit 450. That is, the respective elements are connected through the connectors and the control signal line, thereby simplifying a harness path.

The first and second main connectors 431 and 435 and the connection control line 437 are provided to connect the main board 420 and the HVPS 410. The main board 420 and the HVPS 410 are adjacent to each other to minimize a length of the connection control line 437. The first and second main connectors 431 and 435 are provided at the lateral sides of the HVPS 410 and the main board 420, respectively, adjacent to each other.

For example, if the HVPS 410 is provided at the lateral side of the engine frame 300 and if the main board 420 is provided in the rear side of the engine frame 300 as illustrated in FIG. 3, the first main connector 431 is provided in an upper right side of the HVPS 410 and the second main connector 435 is provided in an upper left side of the main board 420.

If the first and second main connectors 431 and 435 are provided as described above, the first and second connectors 431 and 435 become adjacent to each other when the HVPS 410 and the main board 420 are disposed with respect to the engine frame 300. Thus, the first and second main connectors 431 and 435 may be connected with a shorter connection control line 437, thereby reducing signal loss on the control line 437, reducing costs and simplifying an overall structure.

Referring to FIGS. 4 and 7, the first control panel display unit 450 includes the first control panel board 451 and a first control panel 455 which is controlled by the first control panel board 451 and provided in an external upper side of the cabinet 201. The first control panel 455 includes a display unit to display the operation state of the printing engine 200 thereon, and a control key to control the printing engine 200.

The first control panel board 451 is connected with the first control panel connector 461 provided in the HVPS 410. That is, the first control panel board 451 is provided in the upper portion of the cabinet 201. The first control panel connector 461 is provided to be adjacent to the upper portion of the HVPS 410 as illustrated in FIG. 3 in consideration of the installation position of the first control panel board 451. Thus, the first control panel connector 461 and the first control panel board 451 may be connected with each other through a shorter connection line.

The image forming apparatus according to the present embodiment may further include the second control panel display unit 460 to display and control an operation state of the main board 420. The second control panel display unit 460 includes a second control panel board 461 which is connected with the second control panel connector 461 provided in the main board 420, and a second control panel 466 to display and control the operation state of the main board 420.

The image forming apparatus according to the present embodiment may further include a discharging sensor 270 to detect whether the printing medium having the toner image fused by the fusing unit 260 is discharged. In this case, the discharging sensor 270 is connected with a discharging sensor connector 463 which is adjacent to an upper side of the HVPS 410. As the discharging sensor connector 463 is provided in the upper side of the HVPS 410 in consideration of the discharging sensor 270 provided in an upper side of the first and second cassettes 231 and 235, the discharging sensor 270 and the discharging sensor connector 463 may be connected with each other through a shorter connection line.

The image forming apparatus according to the present inventive concept may further include first and second light scanning connectors 471 and 475 which are connected with each other through a connection line 477 to electrically connect the main board 420 and the light scanning unit 220.

The first light scanning connector 471 is provided in a predetermined position of the light scanning unit 220 to perform the exposing process, e.g. provided in a central portion of a surface opposite to a surface facing the developing unit 210. The second light scanning connector 475 is provided in a predetermined position of the main board 420 facing the first light scanning connector 471. As illustrated in FIG. 4, if the main board 420 is provided in the cabinet 201, the second light scanning connector 475 is provided in a lower side of the main board 420. Thus, the connection line 477 between the first light scanning connector 471 and the second light scanning connector 475 may be as short as possible.

As illustrated in FIGS. 3 and 7, the image forming apparatus according to the present inventive concept may further include a fusing driver board (FDB) 473 and a switching mode power supply (SMPS) 475.

The FDB 473 is controlled by the main board 420 to supply external AC power input through an input unit 471 to the fusing unit 260 and the SMPS 475. Thus, the fusing unit 260 may be turned on and off according to a fusing condition. The SMPS 475 converts the AC power applied by the FDB 473 into DC power to be supplied to the main board 420. The FDB 473 and the SMPS 475 are disposed in a rear side of the engine frame 300 to be adjacent to the main board 420. Then, the connection configuration between the FDB 473, the SMPS 475 and the main board 220 may be simplified, thereby making the circuit configuration compact.

As described above, the image forming apparatus includes the main board 420 and the HVPS 410 in the surfaces adjacent to the engine frame 300, and includes the connectors connected with each other, thereby simplifying the control connection signal line.

The connectors are disposed in the HVPS 410 or in the main board 420 depending on an arrangement of the first and second control panel display units, thereby connecting the elements through a shorter connection signal line.

The feeding unit including the sub electronic elements may be electrically connected with the HVPS, thereby reducing the signal line of the sub electronic elements. The signal is transmitted between the elements through the HVPS, thereby simplifying the assembly configuration of the overall system.

The HVPS, for example, includes the filter and the signals are transmitted from the sub electronic elements to the main board through the HVPS. Accordingly, the noise signal components such as static electricity generated during the printing medium feeding process may be removed. Thus, fair signal components filtered by the HVPS are transmitted to the main board, thereby improving reliability of a connection.

The ground signal line of the various sub electronic elements is also used to connect the HVPS and the main board, thereby reducing a number of the control connection signal lines.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a printing engine including at least one image forming unit to form an image on a printing medium;

a main board, provided at a rear side of the printing engine, for controlling the printing engine according to an image signal; and a high voltage power supply including:

a high voltage generating circuit, disposed on a lateral side of an engine frame supporting the printing engine, to apply a high voltage to the printing engine, and a control signal relay circuit to relay control signal from at least one sub-electric element to the main board, wherein the main board is disposed at an output printing medium receiving side adjacent to the lateral side and perpendicular to a printing medium output direction.

2. The image forming apparatus according to claim 1, wherein the engine frame comprises:

a front surface that faces the printing engine;

a rear surface opposing the front surface and supporting the main board; and opposing first and second side surfaces that extend between the front and rear surfaces and are substantially perpendicular to a movement of the printing medium during printing, wherein the main board is disposed on the rear surface of the engine frame.

3. The image forming apparatus according to claim 2, further comprising:

a first cassette having the at least one sub-electric element among a printing medium detecting sensor, a printing medium pickup unit, and a printing medium duplexer unit, wherein the at least one sub-electric element is electrically connectable to the high voltage power supply through a first feeding connector of the first cassette and a second feeding connector provided to the high voltage power supply, to enable the at least one sub-electric element to output the a control signal to the high voltage power supply.

4. The image forming apparatus according to claim 3, wherein the high voltage power supply comprises:

a noise filter to filter out a noise component of the control signal, wherein the control signal is filtered by the noise filter before being relayed to the main board.

5. The image forming apparatus according to claim 4, wherein the noise component includes static electricity generated during a feeding process of the printing medium.

6. The image forming apparatus of claim 3, further comprising:

a grounding signal line electrically connecting the at least one sub-electric element and the high voltage power supply.

7. The image forming apparatus according to claim 6, further comprising:

a connection control cable to connect a first main connector of the high voltage power supply and a second main connector of the main board, wherein the grounding signal line is common to the high voltage power supply and the main board.

8. The image forming apparatus according to claim 7, wherein the main board and the high voltage power supply have lateral sides disposed adjacent to each other, and the first and second main connectors are respectively provided at the lateral sides, to minimize a length of the connection control cable.

9. The image forming apparatus according to claim 3, wherein the second feeding connector is provided to a lower side of the high voltage power supply, and the first cassette is arranged in a lower side of the engine frame and is disposed such that the first feeding connector is adjacent to the lower side of the high voltage power supply.

10. The image forming apparatus according to claim 3, further comprising:

a second cassette electrically connected with the main board, the second cassette having at least one sub-electric element among a printing medium detecting sensor and a printing medium pickup unit;

a grounding signal line electrically connecting the at least one sub-electric element of the second cassette and the high voltage power supply; and a connection control cable to connect a main connector of the high voltage power supply and a main connector of the main board, wherein the grounding signal line is common to the high voltage power supply and the main board.

11. The image forming apparatus according to claim 1, wherein the high voltage power supply comprises a supply electrode corresponding to each image forming unit.

12. The image forming apparatus according to claim 11, wherein each supply electrode is substantially planar and is arranged on the high voltage power supply to contact each of plural image forming units for forming the image through multiple printing processes.

13. The image forming apparatus according to claim 1, further comprising:

a control panel board to control the printing engine; and a control panel connector provided to an upper portion of the high voltage power supply, wherein the control panel board is arranged in an upper portion of the engine frame, is disposed adjacent to the upper portion of the high voltage power supply, and is electrically connected to the high voltage power supply through the control panel connector.

14. The image forming apparatus according to claim 1, further comprising:

a printing medium discharging sensor electrically connected to the high voltage power supply through a discharging sensor connector arranged on an upper portion of the high voltage power supply.

15. The image forming apparatus according to claim 14, wherein the control signal is transmitted from the printing medium discharging sensor.

16. The image forming apparatus according to claim 1, further comprising:

a light scanning unit which is electrically connected to the main board through a first light scanning connector of the light scanning unit and a second light scanning connector arranged on the main board to face the first light scanning connector.

17. The image forming apparatus according to claim 1, further comprising:

a fusing driver board disposed on a rear surface of the engine frame and controlled by the main board to supply AC power to a fusing unit.

18. The image forming apparatus according to claim 17, further comprising:

a switching mode power supply, disposed on the rear surface of the engine frame, to convert AC power from the fusing driver board into DC power to be supplied to the main board.

19. The image forming apparatus according to claim 1, wherein the main board comprises a system engine controller and a video controller to control a video signal.

20. The image forming apparatus according to claim 19, wherein the high voltage power supply relays the control signal to the system engine controller of the main board.

* * * * *

UNITED STATES PATENT AND TRADEMARK OFFICE

CERTIFICATE OF CORRECTION

PATENT NO. : 8,855,518 B2
APPLICATION NO. : 13/856558
DATED : October 7, 2014
INVENTOR(S) : Yoon-seop Eom et al.

It is certified that error appears in the above-identified patent and that said Letters Patent is hereby corrected as shown below:

In the Claims

Column 10, Line 13, In Claim 1, after “relay” insert -- a --.
Column 10, Line 42, In Claim 3, delete “the a” and insert -- the --, therefor.

Signed and Sealed this
Nineteenth Day of May, 2015

Michelle K. Lee

Michelle K. Lee
*Director of the United States Patent and Trademark Office*